US010510462B2

(12) United States Patent
Kageyama et al.

(10) Patent No.: US 10,510,462 B2
(45) Date of Patent: Dec. 17, 2019

(54) SILVER-COATED RESIN PARTICLES, METHOD FOR MANUFACTURING SAME, AND ELECTROCONDUCTIVE PASTE USING SAME

(71) Applicant: MITSUBISHI MATERIALS ELECTRONIC CHEMICALS CO., LTD., Akita (JP)

(72) Inventors: Kensuke Kageyama, Akita (JP); Hirokazu Tsukada, Akita (JP)

(73) Assignee: MITSUBISHI MATERIALS ELECTRONICS CHEMICALS CO., LTD., Akita (JP)

( * ) Notice: Subject to any disclaimer, the term of this patent is extended or adjusted under 35 U.S.C. 154(b) by 0 days.

(21) Appl. No.: 15/542,246

(22) PCT Filed: Jan. 6, 2016

(86) PCT No.: PCT/JP2016/050217
§ 371 (c)(1),
(2) Date: Jul. 7, 2017

(87) PCT Pub. No.: WO2016/114189
PCT Pub. Date: Jul. 21, 2016

(65) Prior Publication Data

US 2017/0358384 A1 Dec. 14, 2017

(30) Foreign Application Priority Data

Jan. 13, 2015 (JP) ..... 2015-003827
Aug. 6, 2015 (JP) ..... 2015-155600

(51) Int. Cl.

| | |
|---|---|
| ***H01B 5/14*** | (2006.01) |
| ***H01B 1/22*** | (2006.01) |
| ***H01B 13/00*** | (2006.01) |
| ***C23C 18/42*** | (2006.01) |

(52) U.S. Cl.
CPC ..... *H01B 5/14* (2013.01); *C23C 18/42* (2013.01); *H01B 1/22* (2013.01); *H01B 13/0036* (2013.01)

(58) Field of Classification Search
CPC ..... C23C 18/42
See application file for complete search history.

(56) References Cited

U.S. PATENT DOCUMENTS

| | | | | |
|---|---|---|---|---|
| 6,180,213 | B1 * | 1/2001 | Kuroki | B41C 1/1041 428/195.1 |
| 2009/0020733 | A1 * | 1/2009 | Hirakawa | H01B 1/22 252/519.33 |
| 2010/0328895 | A1 * | 12/2010 | Bhagwagar | H01L 23/3736 361/704 |
| 2013/0140501 | A1 * | 6/2013 | Nakabayashi | C23C 18/1641 252/514 |

FOREIGN PATENT DOCUMENTS

| | | | |
|---|---|---|---|
| JP | 1998-284343 | A | 10/1998 |
| JP | 2002-167512 | A | 6/2002 |
| JP | 2010-80408 | A | 8/2010 |
| JP | 2012-243582 | A | 12/2012 |
| JP | 2014-135463 | A | 7/2014 |
| WO | 2003/075295 | A1 | 12/2003 |
| WO | 2011/096288 | A1 | 8/2011 |
| WO | 2012/023566 | A1 | 2/2012 |

OTHER PUBLICATIONS

International Preliminary Report on Patentability issued with respect to Application No. PCT/JP2016/050217 dated Jul. 27, 2017.
Written Opinion of the International Searching Authority from Application No. PCT/JP2016/050217.
International Search Report issued with respect to Application No. PCT/JP2016/050217 dated Apr. 12, 2016.

* cited by examiner

*Primary Examiner* — Alexandre F Ferre
(74) *Attorney, Agent, or Firm* — Greenblum & Bernstein, P.L.C.

(57) ABSTRACT

A silver-coated resin particle including a heat-resistant resin core particle and a silver coating layer formed on the surface of the resin core particle. The average grain diameter of the resin core particle is 0.1 to 10 μm, the amount of silver contained in the silver coating layer is 60 to 90 parts by mass, relative to 100 parts by mass of the silver-coated resin particle, and the exothermic peak temperature of the silver-coated resin particle by differential thermal analysis is 265° C. or higher.

7 Claims, No Drawings

SILVER-COATED RESIN PARTICLES, METHOD FOR MANUFACTURING SAME, AND ELECTROCONDUCTIVE PASTE USING SAME

TECHNICAL FIELD

The present invention relates to a silver-coated resin particle suitable as an electroconductive filler contained in an electroconductive paste, and a method for manufacturing the same. More specifically, the present invention relates to a silver-coated resin particle used in an electroconductive paste provided with superior conductivity and smoothness of an electroconductive film coated and cured, and with high stress relaxation in cases where the electroconductive film is subjected to considerable temperature variation to prevent generation of cracking in a ceramic element and potential cracking in the electroconductive film, and an electroconductive paste using the same. The present application claims a right of priority on the basis of JP2015-003827 filed in Japan on Jan. 13, 2015 and JP2015-155600 filed in Japan on Aug. 6, 2015. The contents of these applications are entirely invoked for the present application.

BACKGROUND ART

One common chip-type electronic part is known as a chip inductor, a chip resistor, a chip-type multilayer ceramic condenser (capacitor), a chip-type multilayer ceramic capacitor, or a chip thermistor. Such a chip-type electronic part includes a chip-type element, essentially including a ceramic sintered body, an inner electrode provided inside of the ceramic sintered body, and an outer electrode provided on both end surfaces of the chip-type element so as to be electrically connected with the inner electrode. These components are mounted on a substrate by soldering the outer electrode.

The above chip-type electronic part is connected with an electric circuit on a substrate by an outer electrode. The quality or performance thereof significantly affects products' electric properties, reliability, and mechanical properties.

In conventional chip-type electronic parts, an outer electrode is formed by mixing an noble powdered metal such as Ag, Pd, and Pt, and an inorganic bonding material, kneading the mixture in an inorganic vehicle, coating both end surfaces of a chip-type element with the resulting conductive paste, and firing the coated body at approximately 500 to 800° C. (referred to as "sintered electrode").

In fact, a conventional outer electrode consisting only of a sintered outer electrode has the following two technical problems. First, such an outer electrode allows for the formation of a nickel-plated film and a tin or tin/palladium plated electrode layer. The nickel-plated film is configured to prevent solder leaching, i.e., dissolution of an outer electrode on the contact surface with the solder. On the other hand, the tin or tin/palladium plated electrode layer is designed to restrict decline in soldering performance by oxidation of the nickel-plated film. Firing conditions of forming an outer electrode determine electric properties of a chip-type electronic part to be obtained after formation of the plated film. This characteristic unfortunately fails to produce highly reliable chip-type electronic parts. Secondly, the structure of an outer electrode formed of sintered metal with high hardness can cause cracking in a ceramic sintered body as part of a chip-type element in temperature cycles in operation.

To solve the aforementioned problems, it is proposed that in such a chip-type electronic part, an end surface of the chip-type element is coated with a resin composition obtained by dispersing a conductive filler such as, particularly, a silver powder in a binder resin such as, particularly, an epoxy resin to be cured. Accordingly, a resin electrode layer as a conductive layer is formed as part of an external terminal electrode. The resin electrode layer is used to relax thermal expansion of the external terminal electrode when thermal stress is applied on the external terminal electrode and prevent generation of cracking (e.g., Patent Documents 1 to 3).

Another chip-type electronic part is disclosed in e.g., Patent Document 4 as a multilayer ceramic capacitor using a conductive resin composition containing a silicone resin consisting of polydimethylsiloxane (PDMS) and a conductive metal particle (conductive filler). This type of multilayer ceramic capacitor includes a conductive resin layer consisting of the above conductive composition as a conductive layer between an outer electrode formed on an end surface of a ceramic element and a plated layer of the outermost layer. The conductive metal particle is composed of copper, silver, or copper coated with silver on the surface. The multilayer ceramic capacitor is excellent in moisture resistance in the conductive resin layer, and the bending strength of the outer electrode in the multilayer ceramic capacitor can be improved. The conductive resin layer is a silicone resin including a binder component composed of PDMS, and high in thermal expansion relaxation when thermal stress is applied on the external terminal electrode on an end surface of a ceramic element.

Meanwhile, an alternative material of a conductive filler consisting of the above metal powder or a metal particle is disclosed in e.g., Patent Document 5 as a metal-coated resin particle plated with conductive metal on the surface of a spherical resin particle. In Patent Document 5, the resin core particle may be an acrylic resin or a styrene resin. The metal-coated resin particle is flexible and of low-specific gravity, with a core consisting of a resin, in place of a conductive metal powder consisting of a conventional silver powder.

PRIOR ART DOCUMENTS

Patent Documents

Patent Document 1: JP-A-H10-284343 (claims 1 and 2, and paragraphs [0002] and [0026])

Patent Document 2: WO2003/075295 (CLAIMS, page. 13)

Patent Document 3: WO2011/096288 (paragraphs [0002], [0003], and [0024])

Patent Document 4: JP-A-2014-135463 (CLAIMS, paragraph [0024])

Patent Document 5: WO2012/023566 (CLAIMS)

SUMMARY OF THE INVENTION

Problem to be Solved by the Invention

A recent trend in the installation of the above chip-type electronic part around an automobile engine compartment requires growing thermal durability (heat resistance) and more vibration- or shock-proof properties under a circumstance with more considerable temperature variation compared with conventional circumstances. The reliability is increasingly demanded not only as single parts, but also as components mounted in combination. Consider that the chip-type electronic parts disclosed in the above Patent Documents 2 and 3 are used under a circumstance with considerable temperature variation. A resin electrode layer (conductive film), consisting of an external terminal electrode, unfortunately causes insufficient relaxation to thermal expansion, vibration, and shock. Consequently, thermal expansion relaxation and vibration/shock relaxation are not at a favorable level, resulting in cracking in a ceramic element, or even in a resin electrode layer (conductive film). This is because of the difference between the coefficient of thermal expansion of a conductive filler consisting of a metal powder or a metal particle contained in the resin electrode layer (conductive film) and the coefficient of thermal expansion of a binder resin is large when thermal stress is applied to the external terminal. Furthermore, the amount of a conductive filler to be added is increased to maintain electrical conductivity of a conductive resin. Consequently, the absolute amount of a resin leading to stress relaxation is small.

Likewise, the conductive resin layer (conductive film) disclosed in Patent Document 4 includes a metal particle in a conductive filler, with a large difference in coefficient of thermal expansion as described above. The thermal expansion relaxation of the conductive resin layer (conductive film) is not sufficient, resulting in potential cracking in a ceramic element or even cracking in a resin conductive layer.

Meanwhile, the metal-coated resin particle disclosed in Patent Document 5 has a major technical problem. Specifically, a resin core particle such as an acrylic resin and a styrene resin itself is less heat-resistant. Consider that a resin electrode layer is formed by a conductive paste containing the metal-coated resin particle (conductive filler) and a binder resin. Although the resin electrode layer is high in thermal expansion relaxation, an external terminal electrode soldered on a substrate causes a resin core particle to be thermally decomposed by the resulting high temperature, and damages the electrode structure. The present inventors found that by replacing a resin core particle with a silicone resin or a fluoric resin having higher heat resistance than the above resin, a silver-coated resin particle powder resistant to high temperature can be produced. With water repellency, however, some of the heat-resistant resins fail to form a tin adsorption layer by electroless plating conducted in an aqueous medium shown in Patent Document 5, and to uniformly form a silver coating layer with high adhesiveness on the surface of a resin core particle. It has been believed that these problems also need solving.

It is an object of the present invention to provide a silver-coated resin particle having a silver coating layer uniformly formed on the surface of a heat-resistant resin core particle with high adhesiveness, and a method for manufacturing the same. Another object of the present invention is to provide an electroconductive paste provided with superior conductivity and smoothness of an electroconductive film after being coated and cured, and in cases where the electroconductive film is used under a circumstance with considerable temperature variation to prevent generation of cracking in the electroconductive film.

Means for Solving the Problem

The present inventors successfully obtained the heat-resistant silver-coated resin particle of this first invention by employing a heat-resistant resin as a resin core particle. The present inventors further obtained a method for manufacturing a silver-coated resin particle of this second invention by modifying the surface of a heat-resistant resin having water repellency and difficulty in obtaining a silver-coated film by a conventional step to perform hydrophilic treatment.

The first viewpoint of the present invention is a silver-coated resin particle including: a heat-resistant resin core particle; and a silver coating layer formed on the surface of the resin core particle. The average grain diameter of the resin core particle is 0.1 to 10 μm, the amount of silver contained in the silver coating layer is 60 to 90 parts by mass, relative to 100 parts by mass of the silver-coated resin particle, and the exothermic peak temperature of the silver-coated resin particle by differential thermal analysis is 265° C. or higher.

The second viewpoint of the present invention is the invention according to the first viewpoint, wherein the heat-resistant resin core particle is a particle of a silicone resin, silicone rubber, a polyimide resin, an aramid resin, a fluoric resin, fluoric rubber, or a silicone shell-acrylic core resin.

The third viewpoint of the present invention is the invention according to the first or second viewpoint, wherein the weight loss ratio of the silver-coated resin particle is 10% or lower when the silver-coated resin particle is heated to 300° C. in thermo gravimetric measurement.

The fourth viewpoint of the present invention is a method for manufacturing a silver-coated resin particle, including the steps of: modifying the surface of the resin particle by subjecting a heat-resistant resin core particle to plasma treatment, ozone treatment, acid treatment, alkaline treatment, or silane treatment; forming a tin adsorption layer on the surface of the resin particle by adding a resin core particle consisting of the surface-modified resin particle to an aqueous solution of a tin compound kept at 25 to 45° C.; forming a silver-substituted layer on the surface of the resin core particle by substitution reaction of the tin adsorption layer formed on the surface of the resin core particle and silver in an electroless plating solution by allowing the electroless silver plating solution containing no reducing agent to come in contact with the tin adsorption layer formed on the surface of the resin core particle; and forming a silver coating layer on the surface of the silver-substituted layer of the resin core particle by adding a reducing agent to the electroless silver plating solution.

The fifth viewpoint of the present invention is the method for manufacturing a silver-coated resin particle according to the fourth viewpoint, wherein the heat-resistant resin core particle is a particle of a silicone resin, silicone rubber, a polyimide resin, an aramid resin, a fluoric resin, fluoric rubber, or a silicone shell-acrylic core resin.

The sixth viewpoint of the present invention is an electroconductive paste consisting of the silver-coated resin particle according to any one of the viewpoints 1 to 3, and one or more binder resins of an epoxy resin, a phenol resin, and a silicone resin.

The seventh viewpoint of the present invention is an electroconductive paste consisting of the silver-coated resin particle according to any one of the viewpoints 1 to 3, a silver particle, and one or more binder resins of an epoxy resin, a phenol resin, and a silicone resin.

The eighth viewpoint of the present invention is an electroconductive paste consisting of the silver-coated resin particle according to any one of claims 1 to 3, a flat silver-coated inorganic particle that is a flat inorganic core particle coated with silver, and one or more binder resins of an epoxy resin, a phenol resin, and a silicone resin.

The ninth viewpoint of the present invention is a method for forming a thermosetting electroconductive film by coating a base material with the electroconductive paste according to any one of the viewpoints 6 to 8 to be cured.

Effect of the Invention

The silver-coated resin particle according to the first viewpoint of the present invention uses a heat-resistant resin core particle. Therefore, the silver-coated resin particle is excellent in heat resistance in that the exothermic peak temperature is high at 265° C. or higher when the silver-coated resin particle is subjected to differential thermal analysis. Also, a resin core particle is not thermally decomposed at the temperature environment of soldering such as reflow soldering.

The heat-resistant resin core particle according to the second and fifth viewpoints of the present invention is a resin particle of a silicone resin, silicone rubber, a polyimide resin, an aramid resin, a fluoric resin, fluoric rubber, or a silicone shell-acrylic core resin. Therefore, such a resin core particle can readily be available.

The silver-coated resin particle according to the third viewpoint of the present invention is more excellent in heat resistance in that the weight loss of the silver-coated resin particle is 10% or lower when the silver-coated resin particle is heated to 300° C. in thermo gravimetric measurement.

In the method for manufacturing a silver-coated resin particle according to the fourth viewpoint of the present invention, a heat-resistant resin core particle is subjected to plasma treatment, ozone treatment, acid treatment, alkaline treatment, or silane treatment to modify the surface of a resin surface particle as a core. Accordingly, the surface of the resin core particle is hydrophilic. Therefore, in an aqueous medium, a tin adsorption layer is uniformly formed on the surface of the resin core particle, and the electroless silver plating thereafter causes a silver coating layer to be uniformly formed on the surface of a resin core particle with high adhesiveness.

The electroconductive paste according to the sixth viewpoint of the present invention is excellent in heat resistance because the paste includes the above-mentioned silver-coated resin particle as an electroconductive filler, and an epoxy resin, a phenol resin or a silicone resin as a binder resin respectively.

The electroconductive paste according to the seventh viewpoint of the present invention is provided with not only superior heat resistance but also electrical conductivity of the electroconductive film after coating and curing because the paste includes a silver particle as an electroconductive filler in addition to the above-mentioned silver-coated resin particle, and includes this electroconductive filler and an epoxy resin, a phenol resin, or a silicone resin as a binder resin.

The electroconductive paste according to the eighth viewpoint of the present invention is provided with not only superior heat resistance but also electrical conductivity of the electroconductive film after coating and curing because the paste includes a flat silver-coated inorganic particle as an electroconductive filler in addition to the above-mentioned silver-coated resin particle, and includes this electroconductive filler and an epoxy resin, a phenol resin, or a silicone resin as a binder resin.

In the thermosetting electroconductive film formed according to the ninth viewpoint of the present invention, not only a binder resin configuring a film, but also a silver-coated resin particle as an electroconductive filler are flexible. Accordingly, the thermal expansion when thermal stress is applied releases thermal stress. Therefore, the layer is excellent in thermal stress relaxation, and use of the electroconductive film under an environment with considerable temperature variation may not generate cracking in an electroconductive film.

EMBODIMENTS OF THE INVENTION

Then, embodiments of the present invention will be described.

[Silver-coated Resin Particle]

The silver-coated resin particle according to this embodiment includes a heat-resistant resin core particle and a silver coating layer formed on the surface of the resin core particle. Illustrative example of the heat-resistant resin core particle includes particles of a silicone resin, silicone rubber, a polyimide resin, an aramid resin, a fluoric resin, fluoric rubber, and a silicone shell-acrylic core resin. The average grain diameter of the resin core particle ranges from 0.1 to 10 μm. The amount of silver contained in the silver coating layer is 60 to 90 parts by mass, relative to 100 parts by mass of the silver-coated resin particle, and the exothermic peak temperature of the silver-coated resin particle when subjected to differential thermal analysis is 265° C. or higher, and preferably 310° C. or higher. The upper limit is 700° C. The thickness of the silver coating layer is preferably 0.1 to 0.3 μm.

The amount of silver to be coated (content) is determined by the average grain diameter of a resin and required electrical conductivity. Consider that the amount of silver contained in a silver coating layer is under 60 parts by mass of the lower limit, and the thickness of the silver coating layer is under 0.1 μm. Dispersion of silver-coated resin particles as an electroconductive filler leads to difficult contact between silver and thus insufficient electrical conductivity. Meanwhile, when the silver content exceeds 90 parts by mass and the thickness of the silver coating layer exceeds 0.3 μm, the specific gravity of the silver-coated resin particle is higher and production costs increase, and the electroconductivity reaches the saturation value. The silver content is preferably 70 to 80 parts by mass. The amount of silver contained in the silver coating layer is the same both in cases where only a silver-coated resin particle is used as an electroconductive filler and a silver particle other than the later-described silver-coated resin particle is used as an electroconductive filler. The amount of silver to be coated is determined by ICP emission spectrophotometric analysis measurement after acidolysis of a silver-coated resin particle.

[Resin Core Particle]

The resin core particle according to this embodiment includes a silicone resin particle, a silicone rubber particle, a polyimide resin particle, an aramid resin particle, a fluoric resin particle, a fluoric rubber particle, and a silicone shell-acrylic core resin particle. The above resin core particle is excellent in heat resistance in that the exothermic peak temperature when subjected to differential thermal analysis is 265° C. or higher, and the weight loss ratio of the silver-coated resin particle when heated to 300° C. in thermo gravimetric measurement is 10% or lower. Consider that the above exothermic peak temperature is under 265° C. When an electroconductive film is formed using an electroconductive paste containing the silver-coated resin particle as an electroconductive filler and soldered, the resulting thermal decomposition in a resin core particle fails to form a favorable electroconductive film. When the weight loss ratio of the silver-coated resin particle exceeds 10% with a silver-coated resin particle heated to 300° C. in thermo gravimetric measurement, an electroconductive film is formed using an electroconductive paste containing the silver-coated resin particle as an electroconductive filler. When the electroconductive film is soldered, however, the resulting thermal decomposition in a resin core particle fails to form a favorable electroconductive film.

Illustrative example of the heat-resistant silicone resin particle includes a polysilsesquioxane resin (PSQ resin) particle and a polysilsesquioxane resin particle. Also, a silicone rubber particle and a silicone shell-acrylic core resin particle can be used. The silicone shell-acrylic core resin particle is prepared by coating an acrylic resin particle with a silicone resin film, on which an inorganic substance such as titanium oxide and alumina may be coated. A protrusion of an inorganic substance such as silicone, titanium oxide and alumina may be found on the surface. Illustrative example of the polyimide resin particle includes a polyamide-imide (PAI) resin particle, illustrative example of the aramid resin particle includes a polymetaphenylene isophthalamide (MPIA) resin particle and a polyparaphenylene terephthalamide (PPTA) resin particle, and illustrative example of the fluoric particle includes a polytetrafluoroethylene (PTFE) resin particle, a tetrafluoroethylene-hexafluoropropylene-vinylidene fluoride (THV) resin particle, a polyvinylidene fluoride (PVDF) resin particle, a polychlorotrifluoro ethylene (PCTFE) resin particle, a chlorotrifluoro ethylene-ethylene (ECTFE) resin particle, a tetrafluoro ethylene-ethylene (ETFE) resin particle, a tetrafluoro ethylene-hexafluoro propylene (FEP) resin particle, and a tetrafluoro ethylene-perfluoroalkylvinyl ether (PFA) resin particle, and also includes a fluoric rubber particle. Illustrative example of the heat-resistant resin as part of other resin particles includes a sulfone resin such as a polyphenylene sulfide (PPS) resin and a polyethersulfone (PES) resin, a cured epoxy (EP) resin powder, polyether ether ketone (PEEK), and polyphenylene ether (PPE), and these resins can be also used.

A resin core particle is a resin particle with an average grain diameter of 0.1 to 10 μm. The resin core particle is preferably a single particle with no aggregation. The average grain diameter more preferably ranges from 0.1 to 5 μm. The reason why the average grain diameter is set to the above range is that the resin core particle is prone to aggregation when the average grain diameter is under a lower limit of 0.1 μm. Further, this property is associated with a larger surface area of the resin core particle, thereby requiring larger amount of silver necessary for obtaining electrical conductivity as an electroconductive filler. With this condition, a favorable silver coating layer is not readily formed. In addition, a resin core particle the average grain diameter of which is under 0.1 μm is not easily available. The average grain diameter of the resin core particle which exceeds 10 μm can cause such disadvantages as decline in surface smoothness of a resin electrode film and higher resistance value by lower contact ratio of an electroconductive particle. In this description, the average grain diameter of a resin core particle refers to the average value of a diameter of 300 silver-coated resins measured with a scanning electron microscope with a power of 5000 (Product from Hitachi High-Technologies Corporation: SU-1500) by SOFTWARE (Product from Hitachi High-Technologies Corporation: PC SEM). The average grain diameter of non-sphericity particles is determined by averaging their long diameters. The resin core particle may be a spherical particle, or non-spherical or irregular (e.g., flat, plate or needle).

The coefficient of variation of the grain diameter of a resin core particle is 10.0% or lower, and the particle size is preferably uniform. This is because other ranges or conditions fail to repeat electrical conductivity of a resin core particle used as an electroconductive filler. The coefficient of variation (CV value in %) is determined by a formula: (standard deviation/average grain diameter)×100 using the particle sizes of the above 300 resins.

[Method for Modifying Surface of Resin Core Particle]

The surface of resin particles of silicone, polyimide, aramid, fluorine, and silicone shell-acrylic core is modified by plasma treatment, ozone treatment, acid treatment, alkaline treatment, or silane treatment. Two or more of these treatments may be performed in combination. These surface modifications make the resin particle hydrophilic.

In plasma treatment, the above resin particle is irradiated with plasma. Illustrative example of the plasma medium includes air, oxygen, nitrogen, argon, helium, water vapor, and ammonia. The plasma treatment is conducted at any appropriate temperature, e.g., from room temperature to high temperature to be used in a heating step, such as at about 100° C., from room temperature to 60° C., at room temperature in particular. The plasma treatment is conducted for approximately one second to 30 minutes.

The plasma treatment is conducted with a plasma generator by setting a frequency from about 24 kHz to 13.56 MHz and a power of about 100 W to 50 kW. The plasma generator is preferably a high-frequency emission plasma, with a preferable ion energy of under about 12.0 eV.

The ozone treatment may be a method for immersing the above resin particle in an ozone gas solution, a method for allowing the above resin particle to come in contact with ozone gas, and other known methods. For example, in a method for immersing the above resin particle in an ozone solution, the ozone solution can be prepared by dissolving ozone gas in a polar solvent. Dissolving ozone in a polar solvent can enhance ozone activity and shorten the time for a hydrophilic step. The polar solvent is particularly preferably water, but as required, may be a mixture of a water-soluble solvent such as alcohol, amide, and ketone, and water.

The ozone concentration in the ozone solution is preferably 1 to 300 mg/L, more preferably 10 to 200 mg/L, and much more preferably 20 to 100 mg/L. The duration of the ozone treatment (duration of immersing the above resin particle in the ozone solution) is preferably 1 to 100 minutes. A higher treating temperature in the ozone solution increases the reaction rate. However, the ozone solubility declines in atmospheric pressure, thereby requiring a pressure device. The treating temperature can be appropriately set in consideration of these relationships, e.g., readily from 10 to 50° C., particularly preferably from about room temperature. The pressure condition in the ozone treatment is determined as to set the ozone gas concentration at a predetermined value. The pressure condition is usually set from a pressurizing condition or a normal pressure condition according to the set ozone concentration and the treating temperature.

In the ozone treatment, it is preferable that means for promoting decomposition of dissolved ozone are used in combination, such as irradiation of the above resin particle with ultraviolet rays or ultrasound with the particle immersed in an ozone solution and addition of alkaline water to an ozone solution in which a base material particle is immersed. Combined use of these means can promote decomposition of dissolved ozone to readily generate a hydroxy radical to be thought to have high oxidation power by ozonolysis. Accordingly, hydrophilic effects can further be increased. Consequently, generation of a hydrophilic group (e.g., OH group, CHO group, and COOH group) on the surface of the above resin particle can further be promoted.

In the acid treatment, the above resin particle is immersed or stirred in aqueous solutions of chromic acid-sulfuric acid, permanganic acid-sulfuric acid, and nitric acid-sulfuric acid, each with a concentration of 0.1 to 15% by mass, and the mixture is allowed to be kept at 30 to 50° C. for 10 to 300 minutes.

In the alkaline treatment, the above resin particle is immersed or stirred in aqueous solutions of caustic soda and potassium hydroxide, each with a concentration of 0.5 to 15% by mass, and the mixture is allowed to be kept at 30 to 50° C. for 10 to 300 minutes. In this treatment, alkaline electrolytic water obtained by adding an electrolyte such as salt for electrolysis can be used singularly or in combination.

In the silane treatment, the above resin particle is subjected to dry processing or wet processing with a silane-based substance such as a silane coupling agent and a silane compound. The silane coupling agent is not specifically restricted, but illustrative example thereof includes polyether silane, 3-glycidoxypropyltrimethoxy silane, vinyltrimethoxy silane, 3-mercaptopropyltrimethoxy silane, 3-aminopropyltrimethoxy silane, 3-isocyanatepropyltrimethoxy silane, and imidazole silane. Illustrative example of the silane compound includes tetramethoxy silane, tetraethoxy silane, tetrapropoxy silane, and tetra-n-butoxy silane. The silane treatment is more effectively performed after the plasma treatment.

[Method for Manufacturing Silver-coated Resin Particle]

The silver-coated resin particle according to this embodiment is manufactured by the following method. First, a resin core particle consisting of the above surface-modified resin particle is added to an aqueous solution of a tin compound kept at 25 to 45° C. to form a tin adsorption layer on the surface of the resin core particle. Subsequently, an electroless silver plating solution containing no reducing agent is allowed to come in contact with the tin adsorption layer formed on the surface of the resin core particle. The resulting substitution reaction between the tin adsorption layer formed on the surface of the resin core particle and silver contained in the electroless plating solution forms a silver-substituted layer on the surface of the resin core particle. Then, a reducing agent is added to the electroless silver plating solution to form a silver coating layer on the surface of the silver-substituted layer of the resin core particle.

[Method for Forming Silver Coating Layer by Electroless Silver Plating]

A silver coating layer is provided on the surface of a resin core particle. Generally, when electroless plating is performed on the surface of a non-conductor such as an organic material and an inorganic material, the surface of the non-conductor needs catalytic treatment beforehand. In this embodiment, a tin adsorption layer is provided on the surface of a resin core particle as catalytic treatment, and subsequently electroless silver plating is conducted to form a silver coating layer. Specifically, the silver coating layer according to this embodiment is manufactured by the following method. First, a resin core particle is added to an aqueous solution of a tin compound kept at 25 to 45° C. to form a tin adsorption layer on the surface of the resin core particle. Subsequently, an electroless silver plating solution containing no reducing agent is allowed to come in contact with the tin adsorption layer. The resulting substitution reaction between the tin adsorption layer formed on the surface of the resin core particle and silver contained in the electroless plating solution forms a silver-substituted layer on the surface of the resin core particle. Then, a reducing agent is added to the electroless silver plating solution to form a silver coating layer on the surface of the silver-substituted layer of the resin core particle.

The above tin adsorption layer is formed by adding the resin core particle to the aqueous solution of the tin compound to be stirred, thereafter subjecting the resin core particle to filtering or centrifugal separation and washing with water. The stirring duration is determined according to the following temperature of the aqueous solution of the tin compound and content of the tin compound, preferably 0.5 to 24 hours. The temperature of the aqueous solution of the tin compound is 25 to 45° C., preferably 25 to 35° C., and more preferably 27 to 35° C. When the temperature of the aqueous solution of the tin compound is under 25° C., the temperature is low enough to cause low activity of the aqueous solution and insufficient adhesion of the tin compound to the resin core particle. When the temperature of the aqueous solution of the tin compound exceeds 45° C., the tin compound oxidizes to make the aqueous solution unstable and cause insufficient adhesion of the tin compound to the resin core particle. With this step taken in the aqueous solution at 25 to 45° C., divalent tin ions adhere to the surface of the resin core particle to form a tin adsorption layer.

Illustrative example of the above tin compound includes stannous chloride, stannous fluoride, stannous bromide, and stannous iodide. When stannous chloride is used, the content of stannous chloride in an aqueous solution of a tin compound is preferably 30 to 100 g/dm$^3$. When the content of stannous chloride is 30 g/dm$^3$ or higher, a tin adsorption layer can uniformly be formed. When the content of stannous chloride is 100 g/dm$^3$ or lower, the amount of inevitable impurities in the stannous chloride is restricted. The stannous chloride can be contained in the aqueous solution of the tin compound until the stannous chloride is saturated.

The aqueous solution of the tin compound preferably contains 0.5 to 2 cm$^3$ of hydrochloric acid, relative to 1 g of stannous chloride. When the amount of hydrochloric acid is 0.5 cm$^3$ or higher, the solubility of stannous chloride is improved and tin hydrolysis is restricted. When the amount of hydrochloric acid is 2 cm$^3$ or lower, the pH of the aqueous solution of the tin compound is not too low, thereby efficiently absorbing tin on a resin core particle.

After a tin adsorption layer is formed on the surface of the resin core particle, an electroless plating solution containing no reducing agent is allowed to come in contact with the tin adsorption layer. The resulting substitution reaction between tin and silver generates a silver-substituted layer on the surface of the resin core particle. Subsequently, a reducing agent is added to the electroless silver plating solution to perform electroless plating. This plating forms a silver coating layer on the surface of the resin core particle to produce a silver-coated resin particle. The electroless silver plating method is classified into the following three methods: (1) method for immersing a resin core particle having a silver-substituted layer formed on the surface of the resin core particle in an aqueous solution containing a complexing agent or a reducing agent to drop a silver salt aqueous solution, (2) method for immersing a resin core particle having a silver-substituted layer formed on the surface of the resin core particle in an aqueous solution containing silver salt or complexing agent to drop a reducing agent aqueous solution, and (3) method for immersing a resin core particle having a silver-substituted layer formed on the surface of the resin core particle in an aqueous solution containing silver salt, complexing agent, or reducing agent to drop a caustic alkali aqueous solution.

The silver salt that can be used may be silver nitrate or silver dissolved in nitric acid. Illustrative example of the complexing agent to be used includes ammonia, ethylenediamine tetraacetic acid, ethylenediamine tetraacetic acid tetrasodium, nitroacetic acid, triethylene tetraammine hexaacetic acid, sodium thiosulfate, succinate salt, succinimide, and salt such as citrate and iodide salt. Illustrative example of the reducing agent includes formalin, glucose, imidazole, Rochelle salt (potassium sodium tartrate), hydrazine and its derivative, hydroquinone, L-ascorbic acid, and formic acid. The reducing agent is preferably formaldehyde having a high reducing power, more preferably a mixture of two or more reducing agents containing at least formaldehyde, and most preferably a mixture of reducing agents containing formaldehyde and glucose.

In a step prior to the electroless silver plating step, tin contained in the tin adsorption layer is allowed to come in contact with a silver ion in the solution to emit electrons for elution. Meanwhile, the silver ion receives the electrons from the tin to perform substitution deposition on a portion having tin of the resin core particle adsorbed as metal. Thereafter, when all the tin is dissolved in the aqueous solution, the substitution reaction of tin and silver is completed. Subsequently, a reducing agent is added to an electroless plating solution, and the resulting reduction reaction by the reducing agent forms a silver coating layer on the surface of a resin core particle to produce a silver-coated resin particle.

[Electroconductive Paste]

An electroconductive paste is an organic vehicle containing: the above silver-coated resin particle as an electroconductive filler; an epoxy resin, a phenol resin or a silicone resin as a binder resin; a curing agent; and a solvent. In the electroconductive paste, the above silver-coated resin particle as an electroconductive filler may be used together with a silver particle with an average grain diameter of 5 μm or lower or a flat silver-coated inorganic particle with an average grain diameter of 10 μm or lower. The flat silver-coated inorganic particle is formed by coating a flat inorganic core particle with silver.

of the flat inorganic particle includes graphite, talc, and mica. Any heat-resistant flat inorganic particle, other than graphite, talc, and mica, which is heat-resistant at 300° C. or higher, can be used as a core particle.

[Ratio of Silver-coated Resin Particle in Electroconductive Paste]

When an electroconductive filler to be contained in an electroconductive paste consists only of a silver-coated resin particle, the ratio of the silver-coated resin particle is preferably 70 to 90% by mass, relative to 100% by mass of a paste, and more preferably 75 to 85% by mass. When the ratio is under 70% by mass, the resistance value of an electrode formed by coating and curing the electroconductive paste or wiring increases. In such a case, an electrode that is excellent in electrical conductivity or wiring is not readily formed. Meanwhile, with a ratio over 90% by mass, a paste having favorable fluidity cannot readily be obtained. Consequently, a favorable electrode cannot readily be formed in terms of printing properties.

[Ratio of Silver-coated Resin Particle to Silver Particle or Flat Silver-coated Inorganic Particle in Electroconductive Paste]

When an electroconductive filler to be contained in an electroconductive paste is a silver-coated resin particle and a silver particle or a flat silver-coated inorganic particle, the ratio of the silver-coated resin particle and the silver particle or the flat silver-coated inorganic particle relative to 100% by mass of a paste is preferably the silver-coated resin particle being 50% by mass or higher and under 100% by mass, and the silver particle or the flat silver-coated inorganic particle being over 0% by mass and under 50% by mass. The ratio of the electroconductive filler that is the sum of the silver-coated resin particle and the silver particle or the flat silver-coated inorganic particle, relative to 100% by mass of the paste, is preferably 70 to 90% by mass, and more preferably 75 to 85% by mass. The silver particle may be spherical, but a flat particle is preferable in that it has more points of contact between fillers to improve electrical conductivity. Preferably, the average grain diameter of the silver particle is 5 μm or lower, and the average grain diameter of the flat silver-coated inorganic particle is 10 μm or lower to provide both electrical conductivity and smoothness of the electroconductive paste after coating and curing. A flat particle has an aspect ratio (long diameter/short diameter) of 2.0 or more. The silver particle preferably has an aspect ratio of 1.5 to 10.0. The flat silver-coated inorganic particle preferably has an aspect ratio of 10.0 to 30.0. The average grain diameter of the silver particle or the flat silver-coated inorganic particle is determined in the same manner as the average grain diameter of the above-described resin core particle. When a silver particle or a flat silver-coated inorganic particle is contained as an electroconductive filler, higher electrical conductivity can be obtained than the case where only the silver-coated resin particle is contained.

[Binder Resin in Electroconductive Paste]

An epoxy resin as a binder resin to be contained in an electroconductive paste is a resin showing solid state at e.g., room temperature and a molten viscosity of a resin of 0.5 Pa·s or lower at 150° C. Illustrative example of the epoxy resin includes biphenyl type, biphenyl mixed type, naphthalene type, cresol novolac type, and dicyclopentadiene type. Illustrative example of the biphenyl type and biphenyl mixed type includes NC3100, NC3000, NC3000L, CER-1020, and CER-3000L (manufactured by Nippon Kayaku Co., Ltd.), and YX4000, YX4000H, and YL6121H (manufactured by Mitsubishi Chemical Corporation). Illustrative example of the cresol novolac type includes N-665-EXP-S (manufactured by DIC Corporation). Illustrative example of the naphthalene type includes HP4032 (manufactured by DIC Corporation). Illustrative example of the dicyclopentadiene type includes HP7200L and HP7200 (manufactured by DIC Corporation). Two or more of these epoxy resins may be used in combination. The molten viscosities shown herein are measured with a cone-and-plate type ICI viscometer (manufactured by Research Equipment London Limited.).

A phenol resin as a binder resin to be contained in an electroconductive paste may be of any structure so long as it is a thermosetting phenol resin. The molar ratio of formaldehyde/phenol preferably ranges from 1 to 2. The weight average molecular weight of the thermosetting phenol resin is preferably 300 to 5000, and more preferably 1000 to 4000. When the weight average molecular weight is under 300, the heating/curing step generates water vapor in large quantities, resulting in voids in a film and insufficient film strength. When the weight average molecular weight is over 5000, the resin is insufficiently soluble and paste processing is unsuccessfully achieved. Part of the thermosetting phenol component used in the present invention may be replaced with a compound having another phenol hydroxyl group. Illustrative example of the resin having a phenol hydroxyl group includes an alkylphenol resole resin using a mixture of p-cresol and o-cresol or m-cresol or 3,5-dimethylphenol, a xylene resin-modified resole resin, and a rosin-modified phenol resin. The weight average molecular weight is determined in a styrene conversion by gel permeation chromatography (GPC).

The silicone resin as a binder resin to be contained in an electroconductive paste is commonly available. Illustrative example of the silicone resin includes a straight silicone resin such as methyl silicone and methylphenyl silicone, an epoxy resin, an alkyd resin, polyester, and a silicone resin modified with an acrylic resin. These resins can be used alone or in combination.

The above-described epoxy resin, phenol resin or silicone resin can restrict quality deterioration by changes of an electroconductive paste over time. Since these resins have a rigid skeleton on the main chain and a cured product is excellent in heat resistance and moisture resistance, the durability of an electrode formed can be improved. These resins are contained in an electroconductive paste, and the mass ratio of one or more binder resins of an epoxy resin, a phenol resin, and a silicone resin to an electroconductive filler is 10 to 40:60 to 90, preferably 20 to 30:70 to 80 (binder resin: electroconductive filler). When the ratio of the binder resin is under the lower limit, a disadvantage of insufficient adhesiveness is generated. When the ratio exceeds the upper limit, a disadvantage such as a decline in electrical conductivity is generated.

[Curing Agent in Electroconductive Paste]

Illustrative example of the curing agent preferably includes generally used imidazole, tertiary amine or Lewis acid containing boron fluoride, and its compound. Illustrative example of the imidazole includes 2-methylimidazole, 2-ethyl-4-methylimidazole, 2-phenylimidazole, 2-phenyl-4-methylimidazole, 2-phenyl-4,5-dihydroxymethylimidazole, 2-phenyl-4-methyl-5-hydroxymethylimidazole, and 2-phenylimidazole isocyanuric acid adduct. Illustrative example of the tertiary amine includes piperidine, benzyldiamine, diethylaminopropylamine, isophoronediamine, and diaminodiphenylmethane. Illustrative example of the Lewis acid containing boron fluoride includes an amine complex of boron fluoride such as boron fluoride monoethyl amine. A high potential curing agent such as DICY (dicyandiamide) maybe used, and the above curing agents may be used in combination as an accelerator of the high potential curing agent. Among these, imidazole's 2-ethyl-4-methylimidazole and 2-phenyl-4,5-dihydroxymethylimidazole are particularly preferable in terms of adhesiveness improvement.

[Solvent in Electroconductive Paste]

Illustrative examples of the solvent include dioxane, hexane, toluene, methyl cellosolve, cyclorohexane, diethylene glycol dimethyl ether, dimethylformamide, N-methylpyrrolidone, diacetone alcohol, dimethylacetamide, γ-butyrolactone, butyl carbitol, butyl carbitol acetate, ethyl carbitol, ethyl carbitol acetate, butyl cellusolve, butyl cellosolve acetate, ethyl cellusolve, and α-terpineol. Among these, ethyl carbitol acetate, butyl carbitol acetate, and α-terpineol are particularly preferable.

[Method for Preparing Electroconductive Paste]

The method for preparing an electroconductive paste is to mix the above binder resin with the above solvent at preferably 50 to 70° C., and more preferably at 60° C. The ratio of the binder resin at this time, relative to 100 parts by mass of the solvent, is preferably 5 to 50 parts by mass, and more preferably 20 to 40 parts by mass. Subsequently, the above curing agent is mixed in appropriate quantities, and the above electroconductive filler is further added thereto. Using a kneader such as 3-roll mill or Raikai mixer, the mixture is kneaded for preferably 0.1 to 1 hour to prepare an electroconductive paste by paste processing. At this time, to provide an electroconductive paste prepared with suitable viscosity and required fluidity and for the above-described reason, the ingredients are mixed so that an electroconductive filler contained in the electroconductive paste is 70 to 90% by mass. Accordingly, the amount of the binder resin used is adjusted by taking account of the above mass ratio to the electroconductive filler for the above-described reason. Consequently, the viscosity is set preferably at 10 to 300 Pa·s. Printing properties of the electroconductive paste are thus improved and the shape of printed patterns is kept favorable.

The electroconductive paste thus prepared is coated on e.g., an end surface of a chip-type element of a chip-type electronic part. The coated body is dried and fired at a predetermined temperature to form a resin electrode layer as part of an external terminal electrode. The product is fired with a circulating hot air oven preferably being kept at 150 to 250° C. for 0.5 to 1 hour. The silver-coated resin particle of the present invention is subjected to thermal treatment at 250° C. or higher and under a melting temperature of a resin core particle in the air to melt and sinter silver in a coated layer. Consider that a silver-coated resin particle having a coated layer containing the molten and sintered silver is used to form the above resin electrode layer. Advantageously, a conductive path in the resin electrode can readily be obtained to produce a resin electrode layer having higher electrical conductivity.

EXAMPLE

Then, Examples and Comparative Examples of the present invention will be described in detail.

Example 1

First, a silicone resin particle as a resin core particle (PSQ resin particle) with an average grain diameter of 2 μm and a coefficient of variation of particle size of 5% was irradiated with oxygen plasma to modify the surface of the resin core particle. Specifically, the above resin particle was subjected to plasma treatment with a plasma generator (manufactured by Plasma Ion Assist Co., Ltd.), with a frequency of 13.56 MHz and a power of 300 W, at 50° C. for 30 minutes.

Then, stannous chloride (20 g) and 15 $cm^3$ of 35% hydrochloric acid were diluted with water (in measuring cylinder) to 1 $dm^3$ using a volumetric flask (volume: 1 $dm^3$) and was allowed to be kept at 30° C. The silicone resin particle subjected to the above plasma treatment was added to the aqueous solution and stirred for one hour. Subsequently, the silicone resin particle was filtered and washed with water as a pretreatment.

Next, a silver-substituted layer was formed by electroless plating on the surface of the silicone resin particle having a tin adsorption layer formed on the surface by the above pretreatment. Specifically, ethylenediaminetetraacetic acid sodium (16 g), as a complexing agent, was first dissolved in 2 $dm^3$ of water to prepare an aqueous solution containing the complexing agent. Then, the silicone resin particle (10 g) after the above pretreatment was immersed in the aqueous solution to prepare a slurry.

Subsequently, silver nitrate (63 g), 25% ammonia water, and 320 $cm^3$ of water were mixed to prepare a silver nitrate-containing aqueous solution with a pH of 10 to 11. The silver nitrate-containing aqueous solution was dropped while the above slurry was stirred to obtain a silver-substituted layer. Further, 920 $cm^3$ of formalin (37% by mass of formaldehyde), as a reducing agent, was added to the slurry after dropping the silver nitrate-containing aqueous solution. Then, a sodium hydroxide aqueous solution was dropped to adjust the pH to 12 and stirred at a constant temperature of 25° C., and silver was deposited on the surface of a resin particle to form a silver coating layer. Thereafter, the product was washed, filtered, and dried with a vacuum dryer at 60° C. to obtain a silver-coated resin particle with 80% by mass of silver, relative to 100% by mass of the silver-coated resin particle.

Thereafter, the above silver-coated resin particle was used as an electroconductive filler with a predetermined ratio to prepare an electroconductive paste. Specifically, in addition to other than the above electroconductive filler, a biphenyl epoxy resin composition (Product from Nippon Kayaku Co., Ltd.: NC3100) showing solid state at room temperature with a molten viscosity of 0.01 Pa·s at 150° C. as a binder resin as part of an organic vehicle, 2-ethyl-4-methylimidazole of an imidazole-based curing agent as a curing agent, and butyl carbitol acetate as a solvent were first prepared.

Then, 30 parts by mass of the binder resin was mixed with 100 parts by mass of the above prepared solvent at 60° C. Further, a curing agent was added to the mixture in appropriate quantities. Subsequently, the above electroconductive filler was added to the mixture after adding the curing agent, so that the ratio of nonvolatile matter contained in the paste prepared was 60% by mass and the mass ratio of the electroconductive filler and the binder resin was 80:20 (electroconductive filler: binder resin). The product was kneaded with a 3-roll mill into a paste to prepare an electroconductive paste.

Example 2

First, a silicone resin particle as a resin core particle (PSQ resin particle) with an average grain diameter of 3 μm and a coefficient of variation of particle size of 5% was subjected to acid treatment to modify the surface of the resin core particle. Specifically, the product was stirred in 2% by mass of a chromic acid-sulfuric acid solution at 50° C. for 60 minutes, and the resulting slurry was filtered to obtain a washed cake. The washed cake was dried to obtain a hydrophilic resin particle.

Then, the silicone resin particle subjected to the above acid treatment was subjected to pretreatment as in Example 1. Next, a silver-substituted layer was formed by electroless plating on the surface of the silicone resin particle having a tin adsorption layer formed on the surface by the above pretreatment. Specifically, ethylenediaminetetraacetic acid sodium (364 g), as a complexing agent, was first dissolved in 2 $dm^3$ of water to prepare an aqueous solution containing the complexing agent. Then, the silicone resin particle (10 g) after the above pretreatment was immersed in the aqueous solution to prepare a slurry.

Subsequently, silver nitrate (37 g), 25% ammonia water, and 280 $cm^3$ of water were mixed to prepare a silver nitrate-containing aqueous solution with a pH of 10 to 11. The silver nitrate-containing aqueous solution was dropped while the above slurry was stirred to obtain a silver-substituted layer. Silver was deposited on the surface of a resin particle to form a silver coating layer as in Example 1. Thereafter, the product was washed, filtered, and dried with a vacuum dryer at 60° C. to obtain a silver-coated resin particle with 70% by mass of silver, relative to 100% by mass of the silver-coated resin particle.

Thereafter, the above silver-coated resin particle was used as an electroconductive filler with a predetermined ratio to prepare an electroconductive paste. Specifically, in addition to the above electroconductive filler, a binder resin, a curing agent, and a solvent, all of which were used in Example 1, were prepared.

Then, 30 parts by mass of the binder resin was mixed with 100 parts by mass of the above prepared solvent at 60° C. Further, a curing agent was added to the mixture in appropriate quantities. Subsequently, the above electroconductive filler was added to the mixture after adding the curing agent, so that the ratio of nonvolatile matter contained in the paste prepared was 70% by mass and the mass ratio of the electroconductive filler and the binder resin was 80:20 (electroconductive filler: binder resin). The product was kneaded with a 3-roll mill into a paste to prepare an electroconductive paste.

Example 3

First, a silicone resin particle as a resin core particle (PSQ resin particle) with an average grain diameter of 10 μm and a coefficient of variation of particle size of 5% was subjected to silane treatment to modify the surface of the resin core particle. Specifically, the silicone resin was placed in a kneader, and a liquid mixture of a silane coupling agent (structural formula: $(MeO)_3SiC_3H_6(OC_2H_4)_n$ OMe) dissolved in ethanol was slowly fed into the product while the silicone resin was stirred in the kneader, and the mixture was stirred for 10 minutes. The resulting powder was dried.

Then, the silicone resin particle subjected to the above acid treatment was subjected to pretreatment as in Example 1. Next, a silver-substituted layer was formed by electroless plating on the surface of the silicone resin particle having a tin adsorption layer formed on the surface by the above pretreatment. Specifically, ethylenediaminetetraacetic acid sodium (312 g), as a complexing agent, was first dissolved in 2 $dm^3$ of water to prepare an aqueous solution containing the complexing agent. Then, silicone resin particle (10 g) after the above pretreatment was immersed in the aqueous solution to prepare a slurry.

Subsequently, silver nitrate (24 g), 25% ammonia water, and 240 $cm^3$ of water were mixed to prepare a silver nitrate-containing aqueous solution with a pH of 10 to 11. The silver nitrate-containing aqueous solution was dropped while the above slurry was stirred to obtain a silver-substituted layer. Further, 144 $cm^3$ of formalin (37% by mass of formaldehyde concentration), as a reducing agent, was added to the slurry after dropping the silver nitrate-containing aqueous solution. Then, a sodium hydroxide aqueous solution was dropped to adjust the pH to 12 and stirred at a constant temperature of 25° C., thereby silver was deposited on the surface of a resin particle to form a silver coating layer. Thereafter, the product was washed, filtered, and dried with a vacuum dryer at 60° C. to obtain a silver-coated resin particle with 60% by mass of silver, relative to 100% by mass of the silver-coated resin particle.

Thereafter, the above silver-coated resin particle was used as an electroconductive filler with a predetermined ratio to prepare an electroconductive paste. Specifically, in addition to the above electroconductive filler, a binder resin, a curing agent, and a solvent, all of which were used in Example 1, were prepared.

Then, 30 parts by mass of the binder resin was mixed with 100 parts by mass of the above prepared solvent at 60° C. Further, a curing agent was added to the mixture in appropriate quantities. Subsequently, the above electroconductive filler was added to the mixture after adding the curing agent, so that the ratio of nonvolatile matter contained in the paste prepared was 70% by mass and the mass ratio of the electroconductive filler and the binder resin was 85:15 (electroconductive filler: binder resin). The product was kneaded with a 3-roll mill into a paste to prepare an electroconductive paste.

Example 4

First, a silicone shell-acrylic core resin particle as a resin core particle with an average grain diameter of 3 μm and a coefficient of variation of particle size of 5% was prepared. The silicone shell-acrylic core resin particle was obtained by stirring an acrylic particle in a system where the particle was dispersed in water and an ethanol solution, adding organotrialkoxysilane thereto to obtain a hydrolysate of organotrialkoxysilane, adding an alkaline substance or its aqueous solution to the hydrolysate, dehydrating and condensing an organotrialkoxysilane hydrolysate, and depositing polyorganosilsesquioxane on the surface of the acrylic particle. The resulting resin core particle was subjected to ozone treatment by injecting ozone gas (gas concentration: 2 vol %) with an ozone generator (Type: Ozone Super Ace, manufactured by Nihon Ozone Co., Ltd.) for 30 minutes to modify the surface.

Then, the silicone shell-acrylic core resin particle subjected to the above acid treatment was subjected to pretreatment as in Example 1. Next, a silver-substituted layer was formed by electroless plating on the surface of the silicone shell-acrylic core resin particle having a tin adsorption layer formed on the surface by the above pretreatment. Specifically, ethylenediaminetetraacetic acid sodium (364 g), as a complexing agent, was first dissolved in 2 $dm^3$ of water to prepare an aqueous solution containing the complexing agent. Then, a silicone shell-acrylic core resin particle (10 g) after the above pretreatment was immersed in the aqueous solution to prepare a slurry.

Subsequently, silver nitrate (37 g), 25% ammonia water, and 280 $cm^3$ of water were mixed to prepare a silver nitrate-containing aqueous solution with a pH of 10 to 11. The silver nitrate-containing aqueous solution was dropped while the above slurry was stirred to obtain a silver-substituted layer. Further, 168 $cm^3$ of formalin (37% by mass of formaldehyde), as a reducing agent, was added to the slurry after dropping the silver nitrate-containing aqueous solution. Then, a sodium hydroxide aqueous solution was dropped to adjust the pH to 12 and stirred at a constant temperature of 25° C., thereby silver was deposited on the surface of a resin particle to form a silver coating layer. Thereafter, the product was washed, filtered, and dried with a vacuum dryer at 60° C. to obtain a silver-coated resin particle with 70% by mass of silver, relative to 100% by mass of the silver-coated resin particle.

Thereafter, the above silver-coated resin particle was used as an electroconductive filler with a predetermined ratio to prepare an electroconductive paste. Specifically, in addition to the above electroconductive filler, a binder resin, a curing agent, and a solvent, all of which were used in Example 1, were prepared.

Then, 30 parts by mass of the binder resin was mixed with 100 parts by mass of the above prepared solvent at 60° C. Further, a curing agent was added to the mixture in appropriate quantities. Subsequently, the above electroconductive filler was added to the mixture after adding the curing agent, so that the ratio of nonvolatile matter contained in the paste prepared was 60% by mass and the mass ratio of the electroconductive filler and the binder resin was 80:20 (electroconductive filler: binder resin). The product was kneaded with a 3-roll mill into a paste to prepare an electroconductive paste.

Example 5

First, a polytetrafluoroethylene resin particle as a resin core particle (PTFE resin particle) with an average grain diameter of 2 μm and a coefficient of variation of particle size of 10% was subjected to plasma treatment and silane treatment to modify the surface of the resin core particle. Specifically, a polytetrafluoroethylene resin particle subjected to plasma treatment as in Example 1 was added to ethanol containing a concentration of 2% by mass of a polyether silane coupling agent (structural formula: $(MeO)_3SiC_3H_6(OC_2H_4)_nOMe$), and stirred at normal temperature for 30 minutes. Thereafter, the resulting slurry was filtered, washed with water, and dried to obtain a hydrophilic fluoric resin particle.

Then, the polytetrafluoroethylene (PTFE) resin particle subjected to the above plasma treatment and silane treatment was subjected to pretreatment as in Example 1. Next, a silver-substituted layer was formed by electroless plating on the surface of the polytetrafluoroethylene resin particle having a tin adsorption layer formed on the surface by the above pretreatment. Specifically, ethylenediaminetetraacetic acid sodium (416 g), as a complexing agent, was first dissolved in 2 $dm^3$ of water to prepare an aqueous solution containing the complexing agent. Then, the polytetrafluoroethylene resin particle (10 g) after the above pretreatment was immersed in the aqueous solution to prepare a slurry.

Subsequently, silver nitrate (63 g), 25% ammonia water, and 320 $cm^3$ of water were mixed to prepare a silver nitrate-containing aqueous solution with a pH of 10 to 11. The silver nitrate-containing aqueous solution was dropped while the above slurry was stirred to obtain a silver-substituted layer. Further, 192 $cm^3$ of formalin (37% by mass of formaldehyde concentration), as a reducing agent, was added to the slurry after dropping the silver nitrate-containing aqueous solution. Then, a sodium hydroxide aqueous solution was dropped to adjust the pH to 12 and stirred while being kept at 25° C., thereby silver was deposited on the surface of a resin particle to forma silver coating layer. Thereafter, the product was washed, filtered, and dried with a vacuum dryer at 60° C. to obtain a silver-coated resin particle with 80% by mass of silver, relative to 100% by mass of the silver-coated resin particle.

Thereafter, the above silver-coated resin particle was used as an electroconductive filler with a predetermined ratio to prepare an electroconductive paste. Specifically, in addition to the above electroconductive filler, a binder resin, a curing agent, and a solvent, all of which were used in Example 1, were prepared.

Then, 30 parts by mass of the binder resin was mixed with 100 parts by mass of the above prepared solvent at 60° C. Further, a curing agent was added to the mixture in appropriate quantities. Subsequently, the above electroconductive filler was added to the mixture after adding the curing agent, so that the ratio of nonvolatile matter contained in the paste prepared was 60% by mass and the mass ratio of the electroconductive filler and the binder resin was 85:15 (electroconductive filler: binder resin). The product was kneaded with a 3-roll mill into a paste to prepare an electroconductive paste.

Example 6

First, a polytetrafluoroethylene resin particle as a resin core particle (PTFE resin particle) with an average grain diameter of 5 μm and a coefficient of variation of particle size of 7% was irradiated with oxygen plasma, as in Example 1, to modify the surface of the resin core particle.

Then, the polytetrafluoroethylene resin particle subjected to the above plasma treatment was subjected to pretreatment as in Example 1. Next, a silver-coated layer was formed by electroless plating on the surface of the polytetrafluoroethylene resin particle having a tin adsorption layer formed on the surface by the above pretreatment. Specifically, ethylenediaminetetraacetic acid sodium (328 g), as a complexing agent, sodium hydroxide (76.0 g) as a pH adjuster, and 151 $cm^3$ of formalin (37% by mass of formaldehyde) as a reducing agent, were added and dissolved in 2 $dm^3$ of water to prepare an aqueous solution containing the complexing agent and the reducing agent. Then, the polytetrafluoroethylene resin particle after the above pretreatment was immersed in the aqueous solution to prepare a slurry.

Subsequently, silver nitrate (27 g), 63 $cm^3$ of 25% ammonia water, and 252 $cm^3$ of water were mixed to prepare a silver nitrate-containing aqueous solution. The silver nitrate-containing aqueous solution was dropped while the above slurry was stirred. Then, a sodium hydroxide aqueous solution was dropped into the slurry after dropping the silver nitrate-containing aqueous solution to adjust the pH to 12 and stirred while being kept at 25° C., thereby silver was deposited on the surface of a resin particle to form a silver coating layer. Thereafter, the product was washed, filtered, and dried with a vacuum dryer at 60° C. to obtain a silver-coated resin particle with 63% by mass of silver, relative to 100% by mass of the silver-coated resin particle.

Thereafter, the above silver-coated resin particle was used as an electroconductive filler with a predetermined ratio to prepare an electroconductive paste. Specifically, in addition to the above electroconductive filler, a binder resin, a curing agent, and a solvent, all of which were used in Example 1, were prepared.

Then, 30 parts by mass of the binder resin was mixed with 100 parts by mass of the above prepared solvent at 60° C. Further, a curing agent was added to the mixture in appropriate quantities. Subsequently, the above electroconductive filler was added to the mixture after adding the curing agent, so that the ratio of nonvolatile matter contained in the paste prepared was 60% by mass and the mass ratio of the electroconductive filler and the binder resin was 85:15 (electroconductive filler: binder resin). The product was kneaded with a 3-roll mill into a paste to prepare an electroconductive paste.

Example 7

First, a polyimide resin particle as a resin core particle (PAI resin particle) with an average grain diameter of 3 μm and a coefficient of variation of particle size of 10% was subjected to alkaline treatment to modify the surface of the resin core particle. Specifically, the product was stirred in 5% by mass of a caustic soda solution at 50° C. for 300 minutes, and the resulting slurry was filtered to obtain a washed cake. The washed cake was dried to obtain a hydrophilic resin particle.

Then, the polyimide resin particle subjected to the above alkaline treatment was subjected to pretreatment as in Example 1. Next, a silver-coating layer was formed by electroless plating on the surface of the polyimide resin particle having a tin adsorption layer formed on the surface by the above pretreatment. Specifically, ethylenediaminetetraacetic acid sodium (333 g), as a complexing agent, was first dissolved in 2 $dm^3$ of water to prepare an aqueous solution containing the complexing agent. Then, the polyimide resin particle (10 g) after the above pretreatment was immersed in the aqueous solution to prepare a slurry.

Subsequently, silver nitrate (28 g), 25% ammonia water, and 284 $cm^3$ of water were mixed to prepare a silver nitrate-containing aqueous solution with a pH of 10 to 11. The silver nitrate-containing aqueous solution was dropped while the above slurry was stirred to obtain a silver-substituted layer. Further, 154 $cm^3$ of formalin (37% by mass of formaldehyde), as a reducing agent, was added to the slurry after dropping the silver nitrate-containing aqueous solution. Then, a sodium hydroxide aqueous solution was dropped to adjust the pH to 12 and stirred at 25° C., and silver was deposited on the surface of a resin particle to form a silver coating layer. Thereafter, the product was washed, filtered, and dried with a vacuum dryer at 60° C. to obtain a silver-coated resin particle with 64% by mass of silver, relative to 100% by mass of the silver-coated resin particle.

Thereafter, the above silver-coated resin particle was used as an electroconductive filler with a predetermined ratio to prepare an electroconductive paste. Specifically, in addition to the above electroconductive filler, a binder resin, a curing agent, and a solvent, all of which were used in Example 1, were prepared.

Then, 30 parts by mass of the binder resin was mixed with 100 parts by mass of the above prepared solvent at 60° C. Further, a curing agent was added to the mixture in appropriate quantities. Subsequently, the above electroconductive filler was added to the mixture after adding the curing agent, so that the ratio of nonvolatile matter contained in the paste prepared was 70% by mass and the mass ratio of the electroconductive filler and the binder resin was 85:15 (electroconductive filler: binder resin). The product was kneaded with a 3-roll mill into a paste to prepare an electroconductive paste.

Example 8

First, an aramid resin particle as a resin core particle (polyparaphenylene terephthalamide resin particle) with an average grain diameter of 5 μm and a coefficient of variation of particle size of 10% was prepared.

Then, an aramid resin particle was subjected to pretreatment as in Example 1. Next, a silver-substituted layer was formed by electroless plating on the surface of the aramid resin particle having a tin adsorption layer formed on the surface by the above pretreatment. Specifically, ethylenediaminetetraacetic acid sodium (369 g), as a complexing agent, was first dissolved in 2 $dm^3$ of water to prepare an aqueous solution containing the complexing agent. Then, the aramid resin particle after the above pretreatment was immersed in the aqueous solution to prepare a slurry.

Subsequently, silver nitrate (28 g), 25% ammonia water, and 284 $cm^3$ of water were mixed to prepare a silver nitrate-containing aqueous solution with a pH of 10 to 11. The silver nitrate-containing aqueous solution was dropped while the above slurry was stirred to obtain a silver-substituted layer. Further, 170 $cm^3$ of formalin (37% by mass of formaldehyde), as a reducing agent, was added to the slurry after dropping the silver nitrate-containing aqueous solution. Then, a sodium hydroxide aqueous solution was dropped to adjust the pH to 12, and stirred while being kept at a temperature of 25° C., thereby silver was deposited on the surface of a resin particle to form a silver coating layer. Thereafter, the product was washed, filtered, and dried at 60° C. with a vacuum dryer at 60° C. to obtain a silver-coated resin particle with 71% by mass of silver, relative to 100% by mass of the silver-coated resin particle.

Thereafter, the above silver-coated resin particle was used as an electroconductive filler with a predetermined ratio to prepare an electroconductive paste. Specifically, in addition to the above electroconductive filler, a binder resin, a curing agent, and a solvent, all of which were used in Example 1, were prepared.

Then, 30 parts by mass of the binder resin was mixed with 100 parts by mass of the above prepared solvent at 60° C. Further, a curing agent was added to the mixture in appropriate quantities. Subsequently, the above electroconductive filler was added to the mixture after adding the curing agent, so that the ratio of nonvolatile matter contained in the paste prepared was 70% by mass and the mass ratio of the electroconductive filler and the binder resin was 85:15 (electroconductive filler: binder resin). The product was kneaded with a 3-roll mill into a paste to prepare an electroconductive paste.

Example 9

First, using a silicone resin particle as a resin core particle (PSQ resin particle) with an average grain diameter of 2 μm prepared as in Example 1, the resin core particle was subjected to plasma treatment as in Example 1. A silver-coated resin particle with 80% by mass of silver, relative to 100% by mass of the silver-coated resin particle, was obtained as in Example 1.

Then, the above silver-coated resin particle and a flat silver particle with an average grain diameter of 5 μm were used as an electroconductive filler with the ratios of 90% by mass of the silver-coated resin particle and 10% by mass of the silver particle, relative to 100% by mass of a paste. Subsequently, the above electroconductive filler was added to the mixture, so that the ratio of the electroconductive filler contained in the paste prepared was 70% by mass and the mass ratio of the electroconductive filler and the binder resin was 75:25 (electroconductive filler: binder resin. The product was kneaded with a 3-roll mill into a paste to prepare an electroconductive paste. The electroconductive paste was prepared as in Example 1, except that a silver, particle was contained.

Example 10

First, a silicone resin particle as a resin core particle (PSQ resin particle) with an average grain diameter of 5 μm and a coefficient of variation of particle size of 3% was subjected to acid treatment as in Example 2 to obtain a silver-coated resin particle with 60% by mass of silver, relative to 100% by mass of the silver-coated resin particle as in Example 2.

Then, the above silver-coated resin particle and a flat silver particle with an average grain diameter of 2 μm were used as an electroconductive filler with the ratios of 80% by mass of the silver-coated resin particle and 20% by mass of the silver particle, relative to 100% by mass of a paste. Subsequently, the above electroconductive filler was added to the mixture, so that the ratio of nonvolatile matter contained in the paste prepared was 60% by mass and the mass ratio of the electroconductive filler and the binder resin was 80:20 (electroconductive filler: binder resin). The product was kneaded with a 3-roll mill into a paste to prepare an electroconductive paste. The electroconductive paste was prepared as in Example 2, except that a silver particle was contained.

Example 11

A silicone shell-acrylic core resin particle as a resin core particle with an average grain diameter of 3 μm was prepared as in Example 4. The silicone shell-acrylic core resin particle was subjected to acid treatment as in Example 2 to obtain a silver-coated resin particle with 70% by mass of silver, relative to 100% by mass of the silver-coated resin particle as in Example 2.

Then, the above silver-coated resin particle and a flat silver particle with an average grain diameter of 5 μm were used as an electroconductive filler with the ratios of 80% by mass of the silver-coated resin particle and 20% by mass of the silver particle, relative to 100% by mass of a paste. Subsequently, the above electroconductive filler was added to the mixture, so that the ratio of the electroconductive filler contained in the prepared paste was 60% by mass and the mass ratio of the electroconductive filler and the binder resin was 80:20 (electroconductive filler: binder resin). The product was kneaded with a 3-roll mill into a paste to prepare an electroconductive paste. The electroconductive paste was prepared as in Example 2, except that a silver particle was contained.

Example 12

A silicone resin particle as a resin core particle (PSQ resin particle) with an average grain diameter of 2 μm prepared as in Example 1 was subjected to plasma treatment as in Example 1 to obtain a silver-coated resin particle with 80% by mass of silver, relative to 100% by mass of the silver-coated resin particle as in Example 1.

Thereafter, the above silver-coated resin particle was used as an electroconductive filler with a predetermined ratio to prepare an electroconductive paste. Specifically, in addition to the above electroconductive filler, a thermosetting phenol resin composition (manufactured by DIC Corporation, Product name: PR15) was prepared as a phenol resin as part of an organic vehicle.

Then, the above electroconductive filler was added to the above phenol resin containing 40% by mass of nonvolatile matter (solvent PGMEA), so that the ratio of nonvolatile matter contained in the paste prepared was 70% by mass and the mass ratio of the electroconductive filler and the binder resin was 80:20 (electroconductive filler: binder resin). The product was kneaded with a 3-roll mill into a paste to prepare an electroconductive paste.

Example 13

A resin rubber particle (silicone rubber powder) as a resin core particle with an average grain diameter of 2 μm was subjected to plasma treatment as in Example 1 to obtain a silver-coated resin particle with 80% by mass of silver, relative to 100% by mass of the silver-coated resin particle as in Example 1.

Thereafter, the above silver-coated resin particle was used as an electroconductive filler with a predetermined ratio to prepare an electroconductive paste. Specifically, in addition to the above electroconductive filler, a phenylmethy silicone resin composition (manufactured by Dow Darning Toray Co., Ltd., Product name: 805 RESIN) was prepared as a silicone resin as part of an organic vehicle.

Then, the above electroconductive filler was added to the above silicone resin containing 50% by mass of nonvolatile matter (solvent: xylene), so that the ratio of nonvolatile matter contained in the paste prepared was 80% by mass and the mass ratio of the electroconductive filler and the binder resin was 80:20 (electroconductive filler: binder resin). The product was kneaded with a 3-roll mill into a paste to prepare an electroconductive paste.

Example 14

A silicone resin particle (PSQ resin particle) as a resin core particle with an average grain diameter of 0.1 μm and a coefficient of variation of particle size of 8% was subjected to plasma treatment as in Example 1 to obtain a silver-coated resin particle with 90% by mass of silver, relative to 100% by mass of the silver-coated resin particle as in Example 1.

Thereafter, the above silver-coated resin particle was used as an electroconductive filler with a predetermined ratio to prepare an electroconductive paste. Specifically, in addition to the above electroconductive filler, a binder resin, a curing agent, and a solvent, all of which were used in Example 1, were prepared.

Then, 30 parts by mass of the binder resin was mixed with 100 parts by mass of the above prepared solvent at 60° C. Further, a curing agent was added to the mixture in appropriate quantities. Subsequently, the above electroconductive filler was added to the mixture after adding the curing agent, so that the ratio of nonvolatile matter contained in the paste prepared was 70% by mass and the mass ratio of the electroconductive filler and the binder resin was 80:20 (electroconductive filler: binder resin). The product was kneaded with a 3-roll mill into a paste to prepare an electroconductive paste.

Example 15

A silver-coated resin particle prepared as in Example 1 and a flat silver-coated inorganic particle with an average grain diameter of 3 μm were prepared. The flat silver-coated inorganic particle is a graphite including a core particle with an aspect ratio of 10, and a silver-coating ratio of 90% by mass. Then, the above silver-coated resin particle and the above flat silver-coated inorganic particle were used as an electroconductive filler with the ratios of 70% by mass of the silver-coated resin particle and 30% by mass of the silver-coated inorganic particle, relative to 100% by mass of a paste. Subsequently, the above electroconductive filler was added to a binder resin, so that the ratio of nonvolatile matter contained in the paste prepared was 80% by mass and the mass ratio of the electroconductive filler and the binder resin was 75:25 (electroconductive filler: binder resin). The product was kneaded with a 3-roll mill into a paste to prepare an electroconductive paste. The electroconductive paste was prepared as in Example 1, except that a flat silver-coated inorganic particle was contained.

Example 16

A silver-coated resin particle prepared as in Example 1 and a flat silver-coated inorganic particle with an average grain diameter of 5 μm were prepared. The flat silver-coated inorganic particle is a talc including a core particle with an aspect ratio of 20, and a silver-coating ratio of 80% by mass. Then, the above silver-coated resin particle and the above flat silver-coated inorganic particle were used as an electroconductive filler with the ratios of 70% by mass of the silver-coated resin particle and 30% by mass of the silver-coated inorganic particle, relative to 100% by mass of a paste. Subsequently, the above electroconductive filler was added, so that the ratio of nonvolatile matter contained in the paste prepared was 75% by mass and the mass ratio of the electroconductive filler and the binder resin was 80:20 (electroconductive filler: binder resin). The product was kneaded with a 3-roll mill into a paste to prepare an electroconductive paste. The electroconductive paste was prepared as in Example 1, except that a flat silver-coated inorganic particle was contained.

Example 17

A silver-coated resin particle prepared as in Example 1 and a flat silver-coated inorganic particle with an average grain diameter of 10 μm were prepared. The flat silver-coated inorganic particle is a mica including a core particle with an aspect ratio of 30, and a silver-coating ratio of 80% by mass. Then, the above silver-coated resin particle and the above flat silver-coated inorganic particle were used as an electroconductive filler with the ratios of 90% by mass of the silver-coated resin particle and 10% by mass of the silver particle, relative to 100% by mass of a paste. Subsequently, the above electroconductive filler was added to the mixture, so that the ratio of nonvolatile matter contained in the paste prepared was 70% by mass and the mass ratio of the electroconductive filler and the binder resin was 80:20 (electroconductive filler: binder resin). The product was kneaded with a 3-roll mill into a paste to prepare an electroconductive paste. The electroconductive paste was prepared as in Example 1, except that a flat silver-coated inorganic particle was contained.

Comparative Example 1

An acrylic resin particle (PMMA resin particle) with an average grain diameter of 2 μm and a coefficient of variation of particle size of 5% was prepared as a resin core particle. The surface of the resin core particle was not modified. A silver-coated resin particle with 80% by mass of silver, relative to 100% by mass of the silver-coated resin particle, was obtained as in Example 1 except for the above condition. Subsequently, the above electroconductive filler was added to the mixture, so that the ratio of nonvolatile matter contained in a paste prepared was 60% by mass and the mass ratio of the electroconductive filler and the binder resin was 80:20 (electroconductive filler: binder resin). The product was kneaded with a 3-roll mill into a paste to prepare an electroconductive paste as in Example 1.

Comparative Example 2

A styrene resin particle with an average grain diameter of 3 μm and a coefficient of variation of particle size of 3% was prepared as a resin core particle. The resin core particle was subjected to acid treatment as in Example 2 to modify the surface. A silver-coated resin particle with 70% by mass of silver, relative to 100% by mass of the silver-coated resin particle, was obtained as in Example 2 except for the above condition. Subsequently, only the above silver-coated resin particle was used as an electroconductive filler. The above electroconductive filler was added to the mixture, so that the ratio of nonvolatile matter contained in a paste prepared was 60% by mass and the mass ratio of the electroconductive filler and the binder resin was 80:20 (electroconductive filler: binder resin). The product was kneaded with a 3-roll mill into a paste to prepare an electroconductive paste as in Example 1.

Comparative Example 3

A melamine resin particle with an average grain diameter of 3 μm and a coefficient of variation of particle size of 7% was prepared as a resin core particle. The resin core particle was subjected to silane coupling treatment as in Example 3 to modify the surface. A silver-coated resin particle with 70% by mass of silver, relative to 100% by mass of the silver-coated resin particle, was obtained as in Example 2 except for the above condition. Subsequently, only the above silver-coated resin particle was used as an electroconductive filler. The above electroconductive filler was added to the mixture, so that the ratio of nonvolatile matter contained in a paste prepared was 60% by mass and the mass ratio of the electroconductive filler and the binder resin was 80:20 (electroconductive filler: binder resin). The product was kneaded with a 3-roll mill into a paste to prepare an electroconductive paste as in Example 1.

Comparative Example 4

A silicone resin particle as a resin core particle (PSQ resin particle) with an average grain diameter of 12 μm and a coefficient of variation of particle size of 4% was used. The resin core particle was subjected to plasma treatment as in Example 1. A silver-coated resin particle with 80% by mass of silver, relative to 100% by mass of the silver-coated resin particle, was obtained as in Example 1. Subsequently, the above silver-coated resin particle and a flat silver particle with an average grain diameter of 2 μm were used as an electroconductive filler with the ratios of 80% by mass of the silver-coated resin particle and 20% by mass of the silver particle, relative to 100% by mass of a paste. Subsequently, the above electroconductive filler was added to the mixture, so that the ratio of nonvolatile matter contained in the paste prepared was 70% by mass and the mass ratio of the electroconductive filler and the binder resin was 80:20 (electroconductive filler: binder resin). The product was kneaded with a 3-roll mill into a paste to prepare an electroconductive paste.

Comparative Example 5

A silicone resin (PSQ resin particle) with an average grain diameter of 2 μm prepared as in Example 1 was prepared as a resin core particle. The surface of the resin core particle was not modified. A silver-coated resin particle with 80% by mass of silver, relative to 100% by mass of the silver-coated resin particle, was obtained as in Example 1 except for the above condition. When the particle was subjected to pre-treatment with a stannous chloride aqueous solution, the resin floats from the stannous chloride aqueous solution, and silver coating is non-uniform in a silver-coated powder obtained. Subsequently, only the above silver-coated resin particle was used as an electroconductive filler. The above electroconductive filler was added to the mixture, so that the ratio of nonvolatile matter contained in a paste prepared was 70% by mass and the mass ratio of the electroconductive filler and the binder resin was 80:20 (electroconductive filler: binder resin), and the product was kneaded with 3-roll mill into a paste to prepare an electroconductive paste as in Example 1.

Comparative Example 6

A silicone resin particle as a resin core particle (PSQ resin particle) with an average grain diameter of 2.0 μm and a coefficient of variation of particle size of 7% was pulverized with a dry ball mill (using zirconia media) for 5 hours to obtain a resin core particle with an average grain diameter of 0.05 μm. The resin core particle was subjected to plasma treatment as in Example 1 to obtain a silver-coated resin particle with 90% by mass of silver, relative to 100% by mass of the silver-coated resin particle. Subsequently, only the above silver-coated resin particle was used as an electroconductive filler. The above electroconductive filler was added to the mixture, so that the ratio of nonvolatile matter contained in a paste prepared was 70% by mass and the mass ratio of the electroconductive filler and the binder resin was 80:20 (electroconductive filler: binder resin), and the product was kneaded with a 3-roll mill into a paste to prepare an electroconductive paste as in Example 1.

Tables 1 to 3 show the type of resin core particles of Examples 1 to 17 and Comparative Examples 1 to 6, the average grain diameter, the surface modification, the silver content in silver-coated resin particles and the average grain diameter of silver particles as part of an electroconductive filler, and its ratio. In Table 1, the core shell resin particle refers to a silicone shell-acrylic core resin particle.

TABLE 1

| | Electroconductive paste | | | | | | | | | |
|---|---|---|---|---|---|---|---|---|---|---|
| | Electroconductive filler | | | | | | | | | |
| | Silver-coated resin particle | | | | | | | | | |
| | Resin core particle | | | Silver | | Silver particle | | | Binder resin | |
| | Type of resin particle | Average grain diameter [μm] | Surface modification | Amount of silver coating [% by mass] | Ratio [% by mass] | Average grain diameter [μm] | Ratio [% by mass] | Ratio [mass ratio] | Type | Ratio [mass ratio] |
| EX 1 | Silicone resin | 2 | Plasma treatment | 80 | 100 | — | 0 | 80 | Epoxy | 20 |
| EX 2 | Silicone resin | 3 | Acid treatment | 70 | 100 | — | 0 | 80 | Epoxy | 20 |
| EX 3 | Silicone resin | 10 | Silane treatment | 60 | 100 | — | 0 | 85 | Epoxy | 15 |
| EX 4 | Core shell resin | 3 | Ozone treatment | 70 | 100 | — | 0 | 80 | Epoxy | 20 |

TABLE 1-continued

| | Electroconductive paste | | | | | | | | | |
|---|---|---|---|---|---|---|---|---|---|---|
| | Electroconductive filler | | | | | | | | | |
| | Silver-coated resin particle | | | | | | | | | |
| | Resin core particle | | | Silver coating | | Silver particle | | | Binder resin | |
| | Type of resin particle | Average grain diameter [μm] | Surface modification | Amount of silver [% by mass] | Ratio [% by mass] | Average grain diameter [μm] | Ratio [% by mass] | Ratio [mass ratio] | Type | Ratio [mass ratio] |
| EX 5 | PTFE resin | 2 | Plasma treatment silane treatment | 80 | 100 | — | 0 | 80 | Epoxy | 20 |
| EX 6 | PTFE resin | 5 | Plasma treatment | 63 | 100 | — | 0 | 85 | Epoxy | 15 |
| EX 7 | Polyimide resin | 3 | Alkaline treatment | 64 | 100 | — | 0 | 85 | Epoxy | 15 |
| EX 8 | Aramid resin | 5 | — | 71 | 100 | — | 0 | 85 | epoxy | 15 |
| EX 9 | Silicone resin | 2 | Plasma treatment | 80 | 90 | 5 | 10 | 75 | epoxy | 25 |
| EX 10 | Silicone resin | 5 | Acid treatment | 60 | 80 | 2 | 20 | 80 | epoxy | 20 |
| EX 11 | Core shell resin | 3 | Acid treatment | 70 | 80 | 5 | 20 | 80 | epoxy | 20 |
| EX 12 | Silicone resin | 2 | Plasma treatment | 80 | 100 | — | 0 | 80 | Phenol | 20 |
| EX 13 | Silicone rubber | 2 | Plasma treatment | 80 | 100 | — | 0 | 80 | silicone | 20 |
| EX 14 | Silicone resin | 0.1 | Plasma treatment | 90 | 100 | — | 0 | 80 | epoxy | 20 |

*EX: Example

TABLE 2

| | Electroconductive paste | | | | | | | | | |
|---|---|---|---|---|---|---|---|---|---|---|
| | Electroconductive filler | | | | | | | | | |
| | Silver-coated resin particle | | | | | Flat silver-coated inorganic particle | | | | |
| | Resin core particle | | | Silver coating layer | | | | | Binder resin | |
| | Type of resin particle | Average grain diameter [μm] | Surface modification | Amount of silver [% by mass] | Ratio [% by mass] | Average grain diameter [μm] | Ratio [% by mass] | Ratio [mass ratio] | Type | Ratio [mass ratio] |
| EX 15 | Silicone resin | 2 | Plasma treatment | 80 | 70 | 3 | 30 | 80 | Epoxy | 20 |
| EX 16 | Silicone resin | 2 | Plasma treatment | 80 | 70 | 5 | 30 | 80 | Epoxy | 20 |
| EX 17 | Silicone resin | 2 | Plasma treatment | 80 | 70 | 10 | 10 | 85 | Epoxy | 20 |

*EX: Example

TABLE 3

| | Electroconductive paste | | | | | | | | | |
|---|---|---|---|---|---|---|---|---|---|---|
| | Electroconductive filler | | | | | | | | | |
| | Silver-coated resin particle | | | | | Silver particle | | | Binder resin | |
| | Resin core particle | | | Silver coating | | | | | | |
| | Type of resin particle | Average grain diameter [μm] | Surface modification | Amount of silver [% by mass] | Ratio [% by mass] | Average grain diameter [μm] | Ratio [% by mass] | Ratio [mass ratio] | Type | Ratio [mass ratio] |
| CE 1 | Acrylic resin | 2 | — | 80 | 100 | — | 0 | 80 | Epoxy | 20 |
| CE 2 | Styrene resin | 3 | Acid treatment | 70 | 100 | — | 0 | 80 | Epoxy | 20 |
| CE 3 | Melamine resin | 3 | Silane treatment | 70 | 100 | — | 0 | 80 | Epoxy | 20 |
| CE 4 | Silicone resin | 12 | Plasma treatment | 80 | 80 | 2 | 20 | 80 | Epoxy | 20 |
| CE 5 | Silicone resin | 2 | — | 80 | 100 | — | 0 | 80 | Epoxy | 20 |
| CE 6 | Silicone resin | 0.05 | Plasma treatment | 90 | 100 | — | 0 | 80 | Epoxy | 20 |

*CE: Comparative Example

Comparative Test and Evaluation

The silver-coated resin particles obtained in Examples 1 to 17 and Comparative Examples 1 to 6 were subjected to differential thermal analysis and thermo gravimetric measurement. Tables 4 and 5 show the volume resistivity of electroconductive films after coating and firing the electroconductive pastes obtained in Examples 1 to 14 and Comparative Examples 1 to 6, the appearance of the same, the volume resistivity of the electroconductive film by thermal treatment in the air, the appearance of the same, and the overall evaluation.

(1) Differential Thermal Analysis and Thermo Gravimetric Measurement of Silver-coated Resin Particle Using an apparatus of simultaneous differential thermal analysis and thermo gravimetric measurement (TG-DTA), the exothermic peak temperature of silver-coated resin particles was measured when the particle was heated in the air from room temperature with a heating rate of 5° C./min. Also, the weight loss of the silver-coated resin particles was measured when the particle was heated to 300° C.

(2) Volume Resistivity of Electroconductive Film Fired and Appearance

An electroconductive paste was coated on a glass substrate using screen printing, dried, and a coating film (electroconductive film) was fired in the air at 180° C. for 1 hour to be cured. The volume resistivity of the electroconductive films was measured by four-terminal connection or four-probe method according to JIS K7197. The appearance of the electroconductive films was visually evaluated from the surface portion of the electroconductive film.

(3) Volume Resistivity of Electroconductive Film after Thermal Treatment in the Air and its Appearance The electroconductive films were placed in an electric oven at 300° C. for 30 minutes and taken out to measure the volume resistivity of the electroconductive films by four-terminal connection or four-probe method according to JIS K 7197. The appearance of the electroconductive films was visually confirmed from the cross-section of the electroconductive films before and after thermal treatment in the air with a scanning electron microscope (SEM) to evaluate changes in the cross-section.

(4) Overall Evaluation

The Examples with favorable results in all the above items (1) to (3) were evaluated "excellent," those with partially not good "good," and those with partially bad "not good."

TABLE 4

| | Silver-coated resin particle | | Electroconductive film | | | | |
|---|---|---|---|---|---|---|---|
| | Differential thermal analysis Exothermic peak temperature [° C.] | Thermo gravimetric measurement Weight loss at 300° C. [%] | After firing | | After thermal treatment in the air | | Overall evaluation |
| | | | Volume resistivity [Ω · cm] | Appearance | Volume resistivity [Ω · cm] | Appearance | |
| EX 1 | 546 | 1 or lower | $3.0 \times 10^{-5}$ | Good | $3.0 \times 10^{-5}$ | No change | Excellent |
| EX 2 | 453 | 1 or lower | $6.0 \times 10^{-5}$ | Good | $8.6 \times 10^{-5}$ | No change | Excellent |

TABLE 4-continued

| | Silver-coated resin particle | | Electroconductive film | | | | |
|---|---|---|---|---|---|---|---|
| | Differential thermal analysis Exothermic peak temperature [° C.] | Thermo gravimetric measurement Weight loss at 300° C. [%] | After firing Volume resistivity [Q · cm] | After firing Appearance | After thermal treatment in the air Volume resistivity [Q · cm] | After thermal treatment in the air Appearance | Overall evaluation |
| EX 3 | 440 | 1 or lower | $9.0 \times 10^{-5}$ | Less smooth | $9.0 \times 10^{-5}$ | No change | Good |
| EX 4 | 310 | 3 | $5.0 \times 10^{-5}$ | Good | $4.0 \times 10^{-5}$ | No change | Excellent |
| EX 5 | 400 | 1 or lower | $4.0 \times 10^{-5}$ | Good | $4.0 \times 10^{-5}$ | No change | Excellent |
| EX 6 | 450 | 1 or lower | $3.0 \times 10^{-5}$ | Good | $2.0 \times 10^{-5}$ | No change | Excellent |
| EX 7 | 323 | 9 | $1.0 \times 10^{-5}$ | Good | $4.0 \times 10^{-5}$ | No change | Good |
| EX 8 | 265 | 9 | $1.0 \times 10^{-5}$ | Good | $10.0 \times 10^{-5}$ | No change | Good |
| EX 9 | 460 | 1 or lower | $0.6 \times 10^{-5}$ | Less smooth | $1.0 \times 10^{-5}$ | No change | Good |
| EX 10 | 440 | 1 or lower | $2.0 \times 10^{-5}$ | Good | $2.0 \times 10^{-5}$ | No change | Good |
| EX 11 | 310 | 4 | $1.0 \times 10^{-5}$ | Less smooth | $3.0 \times 10^{-5}$ | No change | Good |
| EX 12 | 540 | 1 or lower | $0.9 \times 10^{-5}$ | Good | $9.0 \times 10^{-5}$ | No change | Good |
| EX 13 | 348 | 1 or lower | $5.0 \times 10^{-5}$ | Good | $6.2 \times 10^{-5}$ | No change | Good |
| EX 14 | 543 | 1 or lower | $1.0 \times 10^{-5}$ | Less smooth | $2.0 \times 10^{-5}$ | No change | Good |
| EX 15 | 546 | 1 or lower | $9.0 \times 10^{-5}$ | Good | $9.0 \times 10^{-5}$ | No change | Good |
| EX 16 | 546 | 1 or lower | $7.0 \times 10^{-5}$ | Good | $7.0 \times 10^{-5}$ | No change | Good |
| EX 17 | 546 | 1 or lower | $8.0 \times 10^{-5}$ | Good | $8.0 \times 10^{-5}$ | No change | Good |

*EX: Example

TABLE 5

| | Silver-coated resin particle | | Electroconductive film | | | | |
|---|---|---|---|---|---|---|---|
| | Differential thermal analysis Exothermic peak temperature [° C.] | Thermo gravimetric measurement Weight loss at 300° C. [%] | After firing Volume resistivity [Q · cm] | After firing Appearance | After thermal treatment in the air Volume resistivity [Q · cm] | After thermal treatment in the air Appearance | Overall evaluation |
| CE 1 | 259 | 23 | $1.0 \times 10^{-5}$ | Good | $200 \times 10^{-5}$ | Changed | Not good |
| CE 2 | 245 | 17 | $0.1 \times 10^{-5}$ | Good | $1000 \times 10^{-5}$ | Changed | Not good |
| CE 3 | 255 | 11 | $1.0 \times 10^{-5}$ | Good | $100 \times 10^{-5}$ | Changed | Not good |
| CE 4 | 550 | 1 or lower | $9.0 \times 10^{-5}$ | Badly smooth | $9.0 \times 10^{-5}$ | No change | Not good |
| CE 5 | 546 | 1 or lower | $200 \times 10^{-5}$ | Badly smooth | $400 \times 10^{-5}$ | No change | Not good |
| CE 6 | 546 | 1 or lower | $80 \times 10^{-5}$ | Badly smooth | $90 \times 10^{-5}$ | No change | Not good |

*CE: Comparative Example

As is evident in Tables 4 and 5, the exothermic peak temperature of the silver-coated resin particles by differential thermal analysis was 245 to 259° C. in Comparative Examples 1 to 3 with low heat resistance, while the exothermic peak temperature of the silver-coated resin particles in Examples 1 to 17 and Comparative Examples 4 to 6 was 265 to 546° C. with high heat resistance. This is probably because highly heat-resistant resin core particles were used. The weight loss of the silver-coated resin particles in thermo gravimetric measurement when the particles were heated to 300° C. was 11 to 23% in Comparative Examples 1 to 3 with low heat resistance, whereas the weight loss of the silver-coated resin particles in Examples 1 to 17 and Comparative Examples 4 to 6 was 9% or lower with high heat resistance. This is also because highly heat-resistant resin core particles were used.

The volume resistivity of the fired electroconductive films made of electroconductive pastes using silver-coated resin particles was $0.1\times10^{-5}$ to $9.0\times10^{-5}\Omega\cdot$cm in Comparative Examples 1 to 4, while the volume resistivity of the electroconductive films in Examples 1 to 17 was $0.6\times10^{-5}$ to $9.0\times10^{-5}\Omega\cdot$cm, with no remarkable difference between Comparative Examples and Examples. Meanwhile, the electroconductive films in Comparative Examples 5 to 6 showed a high volume resistivity of $80\times10^{-5}$ to $200\times10^{-5}\Omega\cdot$cm. This is because Comparative Example 5 performs no surface modification, resulting in insufficient silver-coating, and Comparative Example 6 shows a smaller particle size of the silver-coated resin particles, thereby causing aggregation and insufficient paste dispersion.

Further, the volume resistivity of the electroconductive films by thermal treatment in the air was $1.0\times10^{-5}$ to $10\times10^{-5}\Omega\cdot$cm in Examples 1 to 17 and Comparative Example 5 with the same level of electrical conductivity, while the volume resistivity of the electroconductive films by thermal treatment in the air in Comparative Examples 1 to 3 was $100\times10^{-5}$ to $1000\times10^{-5}\Omega\cdot$cm with high electrical conductivity. This is because Comparative Examples 1 to 3 cause decomposition of resins by firing in the air.

The appearance of the fired electroconductive films made of electroconductive pastes using silver-coated resin particles showed bad smoothness in Comparative Examples 4 to 6, whereas the appearance in Examples 3, 9, 11, and 14 showed less smoothness. Meanwhile, the appearance in Examples 1 to 8, 10, 12, 13, 15 to 17 and Comparative Examples 1 to 3 was good. This is because the average grain diameter of the silver-coated resin particles in use was large in Comparative Example 4, but small in Comparative Example 6. In Comparative Example 5, silver coating was non-uniform, silver itself deposited in the form of particle in a plating step, and silver coating layers peeled off resin core particles, resulting in aggregation of silver fine powders. In Example 3, the diameter of the silver-coated resin particles was large at 10 μm, resulting in low filling rate of particles in a coating film. Examples 9 and 11 used silver particles with a larger size of 5 μm. In Example 14, the diameter of the silver-coated resin particles was small at 0.1 μm with numerous flocs contained, thereby causing lower surface smoothness. The appearance of the fired electroconductive films made of electroconductive pastes using silver-coated resin particles showed changes in Comparative Examples 1 to 3 due to significant decomposition of the electroconductive films. The electroconductive films in Examples 7 and 8, some of which were decomposed, are not evaluated as noticeably changed. Meanwhile, the appearance in Examples 1 to 6, Examples 9 to 17 and Comparative Examples 4 to 6 was not changed. This is because the heat resistance of the resin core particles varies. Overall, Examples 1, 2, 4 to 6 showed excellent evaluation, Examples 3, 7 to 17 showed good evaluation, and Comparative Examples 1 to 6 showed not good evaluation.

INDUSTRIAL APPLICABILITY

The silver-coated resin particle of the present invention can be used as an electroconductive paste that forms an external terminal electrode of a chip-type electronic part such as a chip inductor, a chip resistor, a chip-type multilayer ceramic condensers (capacitors), a chip-type multilayer ceramic capacitor, and a chip thermistor, a thermal conductive paste for radiating heat mounted on automobiles, and a paste for other electroconductive films soldered. The silver-coated resin particle of the present invention has high antibacterial effects, and thus can be used for antibacterial purposes.

The invention claimed is:

1. A silver-coated resin particle comprising: a heat-resistant resin core particle; and a silver coating layer formed on the surface of said resin core particle, wherein the average grain diameter of said resin core particle is 0.1 to 10 μm, the amount of silver contained in said silver coating layer is 60 to 90 parts by mass, relative to 100 parts by mass of the silver-coated resin particle, and the exothermic peak temperature of the silver-coated resin particle by differential thermal analysis is 310° C. or higher.

2. The silver-coated resin particle according to claim 1, wherein said heat-resistant resin core particle is a particle of a silicone resin, silicone rubber, a polyimide resin, a fluoric resin, fluoric rubber, or a silicone shell-acrylic core resin.

3. The silver-coated resin particle according to claim 1, wherein the weight loss ratio of said silver-coated resin particle is 10% or lower when said silver-coated resin particle is heated to 300° C. in thermo gravimetric measurement.

4. An electroconductive paste consisting of the silver-coated resin particle according to claim 1, and one or more binder resins of an epoxy resin, a phenol resin, and a silicone resin.

5. An electroconductive paste consisting of the silver-coated resin particle according to claim 1, a silver particle, and one or more binder resins of an epoxy resin, a phenol resin, and a silicone resin.

6. An electroconductive paste consisting of the silver-coated resin particle according to claim 1, a flat silver-coated inorganic particle that is a flat inorganic core particle coated with silver, and one or more binder resins of an epoxy resin, a phenol resin, and a silicone resin.

7. A method for forming a thermosetting electroconductive film by coating a base material with the electroconductive paste according to claim 4 to be cured.

* * * * *